US006067804A

United States Patent [19]

Moeykens et al.

[11] Patent Number: 6,067,804

[45] Date of Patent: May 30, 2000

[54] THERMOSIPHONIC OIL COOLER FOR REFRIGERATION CHILLER

[75] Inventors: Shane A. Moeykens; Benjamin E. Dingel; James W. Larson, all of La Crosse, Wis.

[73] Assignee: American Standard Inc., Piscataway, N.J.

[21] Appl. No.: 09/369,621

[22] Filed: Aug. 6, 1999

[51] Int. Cl.[7] ..... F25B 43/02

[52] U.S. Cl. ..... 62/84; 62/468; 62/469

[58] Field of Search ..... 62/84, 192, 468, 62/469, 470, 471; 418/85

[56] References Cited

U.S. PATENT DOCUMENTS

| | | | |
|---|---|---|---|
| 320,308 | 6/1885 | Suckert . | |
| 2,322,874 | 6/1943 | Neeson et al. | 62/115 |
| 3,548,612 | 12/1970 | Mitsubayashi et al. | 62/469 |
| 3,820,350 | 6/1974 | Brandin et al. | 62/193 |
| 5,419,155 | 5/1995 | Boehde et al. | 62/470 |
| 5,433,590 | 7/1995 | Klaus et al. | 418/85 |
| 5,603,222 | 2/1997 | Dube | 62/469 X |

FOREIGN PATENT DOCUMENTS 403079959 4/1991 Japan .

*Primary Examiner*—Chen-Wen Jiang
*Attorney, Agent, or Firm*—Willaim J. Beres; William O'Driscoll; Peter D. Ferguson

[57] ABSTRACT

Oil cooling is accomplished in a refrigeration chiller by flowing hot oil into heat exchange contact with liquid refrigerant which is sourced from the chiller's condenser and returned thereto. The rejection of heat from the oil to the refrigerant in an oil-cooling heat exchanger causes vaporization of the refrigerant and, in turn, creates a density difference in the refrigerant flowing from the condenser and refrigerant in and downstream of the oil-cooling heat exchanger. This density difference is responsible for inducing and maintaining refrigerant flow through the heat exchanger for oil cooling purposes.

20 Claims, 1 Drawing Sheet

THERMOSIPHONIC OIL COOLER FOR REFRIGERATION CHILLER

BACKGROUND OF THE INVENTION

The present invention relates to refrigeration chillers. More specifically, the present invention relates to the cooling of compressor lubricant in a refrigeration chiller. With still more specificity, the present invention relates to the cooling of compressor lubricant in a refrigeration chiller by chiller system refrigerant sourced from and returned to the chiller's condenser by thermosiphonic effect.

Refrigeration chillers employ compressors of varying types to compress a refrigerant gas which is first condensed and then vaporized in the process of cooling a heat load. Such compressors most typically have rotating elements that are supported for rotation in one or more bearings that require lubrication in order to function. The reliability of the bearings and, therefore, the overall reliability of the chiller is enhanced by cooling the oil used to lubricate the bearings prior to its delivery to the bearing surfaces.

There are a great many methodologies and various apparatus by which oil cooling in a refrigeration chiller has been accomplished. Many cooling mediums, many and different kinds of heat exchangers and many and different motive forces by which to move the oil and the medium by which it is cooled into heat exchange contact have been employed. Many times, at least the flow of the medium by which oil has been cooled in refrigeration chillers has required the use of a pump, eductor or other mechanical or electromechanical apparatus which, in turn, adds expense to and/or complicates the chiller fabrication process and/or requires the use of valving and/or controls. The use of such mechanical or electromechanical apparatus, valves and/or controls associated with the oil cooling process also brings with it potential failure modes that detract from the overall reliability of chiller systems.

The need therefore exists for apparatus and a method, for use in a refrigeration chiller, by which to cool the oil which lubricates the bearings of the chiller's compressor where such apparatus and methodology are essentially fail-safe and do not require the employment of mechanical and/or electromechanical apparatus, valving and/or controls to cause the flow of the lubricant cooling medium into heat exchange contact with the lubricating oil that requires cooling.

SUMMARY OF THE INVENTION

It is an object of the present invention to cause the cooling of oil used to lubricate the bearings of the compressor in a refrigeration chiller.

It is a still further object of the present invention to cool the oil used to lubricate the bearings in a refrigeration chiller in a manner which does not require the use of mechanical or electromechanical apparatus, valving and/or controls which are dedicated to the purpose of causing the movement of the medium by which the oil is cooled into heat exchange contact with the oil.

It is a further object of the present invention to cool the oil used to lubricate the bearings of the compressor of a refrigeration chiller using chiller system refrigerant.

It is another object of the present invention to cool the oil used to lubricate the bearings of the compressor in a refrigeration chiller using system refrigerant and in a manner which least detrimentally affects the overall efficiency of the chiller system.

It is a still further object of the present invention to cool the oil used to lubricate the bearings of the compressor of a refrigeration chiller using system refrigerant which is both sourced from and returned to the chiller's condenser.

It is another object of the present invention to cool the oil used to lubricate the bearings of the compressor in a refrigeration chiller using system refrigerant in its liquid state which is at least partially vaporized during the oil cooling process, such vaporization resulting in the creation of a pressure differential within the path through which refrigerant flows for the oil cooling purpose that allows the return of such refrigerant, in two-phase form, to the system condenser.

Finally, it is an object of the present invention to cool the bearings of the compressor in a refrigeration chiller using system refrigerant, the movement of which from and back to the system condenser is as a result of thermosiphonic flow that is self-sustaining when the chiller is in operation.

These and other objects of the present invention, which will be appreciated when the following Description of the Preferred Embodiment and attached Drawing Figures are considered, are accomplished by the disposition of an oil-cooling heat exchanger at a location in a refrigeration chiller that results in the flow of liquid refrigerant from the system condenser thereto by force of gravity and from which refrigerant is returned to the condenser in a self-sustaining process induced by thermosiphonic effect. In that regard, an oil-cooling heat exchanger is disposed below the condenser in a refrigeration chiller so that a column of slightly subcooled liquid refrigerant is formed in the piping that connects the bottom of the condenser to the oil-cooling heat exchanger. Hot system lubricant is delivered to the oil-cooling heat exchanger where it rejects heat to the slightly subcooled liquid refrigerant that is made available therein from the system condenser. The rejection of heat from the oil to the liquid refrigerant in the oil-cooling heat exchanger causes a portion of the refrigerant to vaporize and rise out of the heat exchanger through a line that connects the oil cooling heat exchanger to the vapor space in the system condenser. The refrigerant rising through the return line to the condenser after oil cooling is achieved is a two-phase mixture of saturated liquid and vaporized refrigerant that has a lower bulk average density than the subcooled liquid refrigerant which is supplied to the oil-cooling heat exchanger from the condenser. The density difference between the refrigerant being supplied to and being returned from the oil-cooling heat exchanger creates a pressure differential that induces self-sustaining refrigerant flow from the condenser, through the oil cooling heat exchanger and back to the condenser vapor space in a thermosiphonic process.

DESCRIPTION OF THE DRAWING FIGURE

The Drawing FIGURE is a schematic illustration of a refrigeration chiller in which the oil-cooling arrangement of the present invention is employed.

DESCRIPTION OF THE PREFERRED EMBODIMENT

Figure 1:
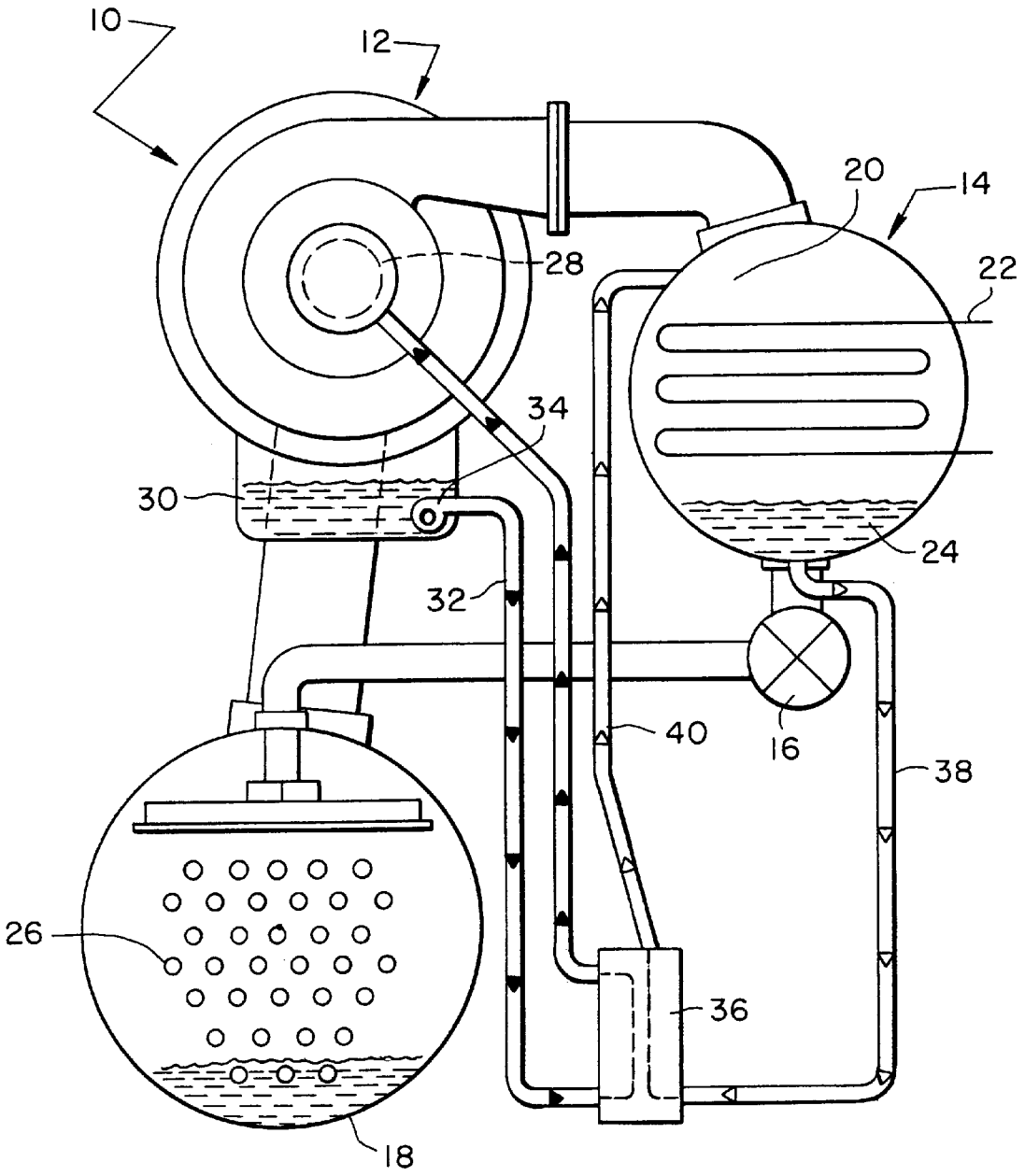

Refrigeration chiller 10 includes a compressor 12, a condenser 14, an expansion device 16 and an evaporator 18, all of which are connected for flow to form a refrigeration circuit. In operation, compressor 12, which, in the preferred embodiment, is a centrifugal compressor, compresses system refrigerant and discharges it in the form of a relatively high pressure, hot gas into the vapor space 20 of condenser 14. Condenser 14, in the chiller of the preferred embodiment is elevated and located generally above evaporator 18.

The hot, high pressure refrigerant gas is cooled by a medium, such as water flowing through tube bundle 22 of condenser 14, and condenses to liquid form. The condensed refrigerant pools at the bottom 24 thereof. In certain types of chillers, ambient air is used to cool the refrigerant gas discharged from the condenser.

Condensed refrigerant flows from condenser 14 to expansion device 16 where, by the process of expansion, a portion of the refrigerant vaporizes and the refrigerant is cooled. The now cooler, lower pressure, two-phase refrigerant is delivered into evaporator 18 which preferably is an evaporator of the falling film type. It is to be noted here that while compressor 12 in the preferred embodiment is a centrifugal compressor and while evaporator 18 in the preferred embodiment is an evaporator of the falling film type, the present invention applies to chiller systems in which evaporators and compressors of other types are employed.

A medium such as water flows through tube bundle 26 in the evaporator, that medium being returned from the heat load which it is the purpose of chiller 10 to cool. As the relatively warm medium enters evaporator 18 it comes into heat exchange contact with the refrigerant that is delivered thereinto from expansion device 16. The medium flowing through tube bundle 26 is cooled as it rejects its heat to the refrigerant in the evaporator. The refrigerant is vaporized by such heat and is drawn back to compressor 12 in an ongoing process. The medium cooled in the evaporator is returned to the heat load to further cool it, likewise in an ongoing process.

As is the case in many refrigeration chillers, compressor 12 employs one or more rotating parts. In the case of the centrifugal compressor of the preferred embodiment, the moving part will be an impeller (not shown) which is mounted for rotation upon a shaft (not shown) carried in at least one bearing, such as bearing 28. As is the case with most bearings, lubrication thereof is required and as is the case in most bearing applications, lubrication is accomplished by the delivery of oil to the bearing location. As is also the case in essentially all bearing applications, the oil delivered to a bearing is heated as a result of its use in the lubrication of the bearing. Because bearing life is enhanced by cooling the oil by which it is lubricated, oil-cooling schemes are typically employed in many bearing applications.

In the chiller system of the preferred embodiment and with the above in mind, bearing lubrication oil in chiller 10 is sourced from an oil sump 30 and is delivered to bearing 28 through a lubricant supply line 32. A pump 34, disposed in sump 30, provides the motive force for delivering oil through oil supply line 32 to the bearing. The oil is heated in the bearing lubrication process so that upon its return to the sump it will be relatively hot and will benefit from cooling prior to further use for lubrication purposes.

The oil-cooling arrangement of the present invention is predicated on the disposition of an oil cooling heat exchanger at a location in the chiller system which is below the system condenser. In the case of the present invention, oil cooling heat exchanger 36 is preferably a heat exchanger of the brazed plate type to which condensed system refrigerant is delivered from refrigerant pool 24 in condenser 14 through refrigerant supply line 38. Because condenser 14 is disposed above oil-cooling heat exchanger 36, the liquid refrigerant in line 38 forms a liquid column comprised of slightly subcooled liquid refrigerant which is at a first density. As will be appreciated, while the high pressure liquid refrigerant is drawn directly from the condenser in the preferred embodiment, it could likewise be drawn from downstream thereof but upstream of expansion device 16.

The slightly subcooled liquid refrigerant delivered into oil-cooling heat exchanger 36 through line 38 is brought into heat exchange contact with the relatively hot oil that is pumped to and through oil-cooling heat exchanger 36 by pump 34 through oil supply line 32. The exchange of heat between the relatively hot oil and the relatively more cool refrigerant within oil-cooling heat exchanger 36 causes a portion of the refrigerant to vaporize. A two-phase, liquid-vapor refrigerant mixture is therefore created by the oil cooling process that occurs within oil cooling heat exchanger 36. This two-phase refrigerant mixture, which is less dense than the column of liquid refrigerant delivered to the oil cooling heat exchanger through line 38, rises through refrigerant return line 40 as a result of the true thermosiphon loop created by the path through which the oil-cooling refrigerant flows.

The movement of the refrigerant through the thermosiphon loop is assisted by the static head created by the liquid refrigerant column which is built up ahead of the oil-cooling heat exchanger in liquid refrigerant supply line 38. Because refrigerant flow is both to and from the condenser and is, therefore, to and from locations that are at essentially the same pressure, the assist from the static head created by the liquid refrigerant column ensures that the thermosiphonic refrigerant movement to, through and from oil-cooling heat exchanger 36 is self-sustaining under all chiller operating conditions despite the frictional flow losses and static head that will be associated with the return of two-phase refrigerant from the heat exchanger to the vapor space of the condenser.

It is to be noted that refrigerant flow through the oil-cooling heat exchanger will preferably be cocurrent as opposed to counter-flow in nature in the preferred embodiment. That is, hot oil pumped from the oil sump is delivered into heat exchange contact with liquid refrigerant as the refrigerant is delivered into the oil-cooling heat exchanger where the refrigerant will be at its coldest. This ensures that the oil at its hottest is brought into heat exchange contact with liquid refrigerant at its coldest as soon as possible within that oil-cooling heat exchanger so as to take advantage of the large initial temperature differential between the two fluids. The large initial temperature differential induces boiling/vaporization in the refrigerant at the earliest opportunity within the oil-cooling heat exchanger which, in turn, helps to induce and maintain refrigerant flow therethrough.

Because the medium used to cool the oil in the present invention is refrigerant sourced from the condenser and because condenser temperatures will vary, the temperature of oil leaving oil-cooling heat exchanger 36 will vary with the saturated condenser temperature. In each case, however, oil-cooling is obtained that is sufficient to assure the adequate, continuous and reliable lubrication of the compressor bearings and any other surfaces or locations within compressor 12 that require lubrication.

It is to be noted that the thermosiphonic oil-cooling arrangement of the present invention requires the diversion of only a very small amount of system refrigerant from the system condenser to the oil-cooling heat exchanger. Therefore, oil cooling is achieved in a refrigeration chiller in a manner which minimizes the detrimental affect of the oil cooling process on the overall efficiency of the chiller system.

It is further to be noted that refrigerant leaving the oil-cooling heat exchanger is both sourced from and returned to the system condenser as compared to other oil cooling schemes in which the refrigerant used to cool oil is returned to a different chiller location where refrigerant pressure is lower. As such, the system compressor is not required to perform work on the refrigerant used for oil cooling in order to return it to condenser pressure. This to minimizes the detrimental effect of the oil cooling process on overall chiller system efficiency.

It is still further to be noted that by the development of true thermosiphonic flow, as a result of the density differences between the liquid refrigerant in supply line 38 and the two-phase refrigerant mixture in line 40, and with the assistance of the static head developed by the column of liquid refrigerant in line 38, self-sustaining flow of the medium by which oil is cooled is established and maintained without the need for mechanical or electromechanical apparatus, valving or controls to cause or regulate the flow of the medium by which oil is cooled. As such, the oil cooling arrangement of the present invention is reliable, simple and economical while minimizing the adverse effects on chiller system efficiency that are attendant in other chiller oil cooling schemes.

While the present invention has been described in terms of a preferred embodiment, it will be apparent to those skilled in the art that other embodiments thereof, falling within its scope, are contemplated.

What is claimed, under that premise, is:

1. A refrigeration chiller comprising:

a condenser;

an expansion device;

an evaporator;

a compressor, said condenser, said expansion device, said evaporator and said compressor being connected for flow so as to form a refrigeration circuit;

an oil-cooling heat exchanger;

an oil sump, oil being delivered from said sump to a location in said chiller that requires lubrication, said oil flowing through said oil-cooling heat exchanger prior to being delivered to said location requiring lubrication;

a supply line through which liquid refrigerant sourced from said condenser flows to said oil-cooling heat exchanger; and a return line through which refrigerant flows from said oil-cooling heat exchanger, after being heated by oil flowing therethrough, to a location in said chiller which is at condenser pressure, the flow of refrigerant through said return line occurring as a result of the rejection of heat from the oil flowing through said oil-cooling heat exchanger to refrigerant therein.

2. The refrigeration chiller according to claim 1 wherein said rejection of heat from the oil flowing through said oil-cooling heat exchanger to refrigerant therein causes the vaporization of a portion of said refrigerant and the creation of a mixture of liquid and vaporized refrigerant in said return line, the density of said mixture being less than the density of the liquid refrigerant in supply line, the difference in density therebetween creating a pressure differential which induces refrigerant flow out of said oil-cooling heat exchanger.

3. The refrigeration chiller according to claim 2 wherein said return line communicates between said oil-cooling heat exchanger and said condenser.

4. The chiller according to claim 1 wherein said oil-cooling heat exchanger is disposed below said condenser, the disposition of said oil-cooling heat exchanger below said condenser and the liquid refrigerant in said supply line cooperating to create a static head in said supply line, said static head assisting in obtaining and sustaining the flow of refrigerant from said heat exchanger back to said condenser.

5. The chiller according to claim 4 wherein said liquid refrigerant sourced from said condenser flows directly from a location generally at the bottom of said condenser to said oil-cooling heat exchanger and wherein the entire amount of the refrigerant flowing through said supply line flows to and through said oil-cooling heat exchanger and is returned to the vapor space of said condenser.

6. The chiller according to claim 5 wherein the flow of refrigerant through said return line from said oil-cooling heat exchanger to said condenser is in the absence of any valves or controls for regulating such flow and in the absence of any motivating force other than said density difference and said static heat in said supply line.

7. The chiller according to claim 5 wherein said oil-cooling heat exchanger is a brazed plate heat exchanger.

8. The chiller according to claim 5 wherein the flow of liquid refrigerant and the flow of oil through said oil-cooling heat exchanger is cocurrent in that liquid refrigerant at its coldest and oil at its hottest is brought into initial heat exchange contact within said oil-cooling heat exchanger so as to take advantage of the relatively large initial temperature difference therebetween to induce vaporization of said refrigerant as soon as possible in said heat exchanger.

9. A refrigeration chiller comprising:

a condenser;

an expansion device;

an evaporator;

an oil sump;

a compressor, oil flowing to said compressor from said sump when said chiller is in operation, said condenser, said expansion device, said evaporator and said compressor being connected for flow so as to form a refrigeration circuit; and a thermosiphon oil cooler, oil flowing from said sump through said thermosiphon oil cooler prior to its delivery to said compressor and refrigerant flowing to and from said thermosiphon oil cooler, said oil and said refrigerant being brought into heat exchange contact therein, the temperature of refrigerant flowing to said oil cooler being lower than the temperature of oil flowing to and through said oil cooler so that said oil rejects heat to said refrigerant therein, said rejection of heat causing vaporization of a portion of said refrigerant and the creation of a mixture of refrigerant in and downstream of said heat exchanger the density of which is less than the density of refrigerant flowing to said oil cooler, said density difference causing the flow of refrigerant from said thermosiphon oil cooler to a location in said chiller which is at condenser pressure.

10. The chiller according to claim 9 wherein the flow of refrigerant to said thermosiphon oil cooler is from said condenser and is in liquid form and wherein said flow of refrigerant from said thermosiphon oil cooler is back to said condenser and is in the form of a two-phase refrigerant mixture.

11. The chiller according to claim 10 wherein said rejection of heat in said thermosiphon oil cooler is at a location physically below said condenser, said liquid refrigerant sourced from said condenser flowing downward from said condenser to said thermosiphon oil cooler thereby resulting in the creation of static head in the liquid refrigerant upstream of said thermosiphon oil cooler, said static head assisting said density difference in causing the self-sustaining flow of refrigerant to, through and out of said oil cooler when said chiller is in operation.

12. The chiller according to claim 11 wherein the flow of liquid refrigerant to said thermosiphon oil cooler is directly from said condenser and wherein the flow of refrigerant from said thermosiphon oil cooler is to the vapor space of said condenser.

13. The chiller according to claim 12 wherein the flow of refrigerant to, through and out of said thermosiphon oil cooler and back into said condenser occurs in the absence of any valves or controls dedicated to regulating such flow and is in the absence of any motivating force but said density difference and gravity.

14. The chiller according to claim 13 wherein the flow of refrigerant and oil through said thermosiphon oil cooler in cocurrent so that refrigerant at its coolest and oil at its hottest is brought into immediate heat exchange contact upon entry into said oil cooler.

15. The chiller according to claim 14 wherein said oil cooler is a brazed plate heat exchanger.

16. A method of cooling oil in a refrigeration chiller comprising the steps of:

passing relatively warm oil through an oil-cooling heat exchanger prior to the delivery thereof to a location in said chiller that requires lubrication;

flowing liquid refrigerant from said condenser to said oil-cooling heat exchanger;

rejecting heat from the oil passing through said oil-cooling heat exchanger in said passing step to the liquid refrigerant delivered into said heat exchanger in said flowing step in sufficient quantity to cause the vaporization of a portion of said liquid refrigerant and the creation of a two-phase mixture of refrigerant in said heat exchanger, the density of the liquid refrigerant delivered into said heat exchanger being higher than the density of said two-phase refrigerant mixture; and returning refrigerant, at least a portion of which is in gaseous form, from said oil-cooling heat exchanger back to said condenser, the flow of refrigerant back to said condenser being as a result of said density difference between the liquid refrigerant delivered into said oil-cooling heat exchanger and the two-phase refrigerant mixture in and downstream of said oil-cooling heat exchanger.

17. The method according to claim 16 comprising the further step of disposing said oil-cooling heat exchanger below said condenser so that refrigerant in and downstream of said oil-cooling heat exchanger is subjected to static head created by the liquid refrigerant upstream thereof, said static head assisting in sustaining the flow of refrigerant to, through and from said oil-cooling heat exchanger when said chiller is in operation.

18. The method according to claim 17 wherein said step of connecting said oil-cooling heat exchanger to receive liquid refrigerant from said condenser includes the step of routing liquid refrigerant directly from the liquid pool in said condenser to said oil-cooling heat exchanger and wherein said step of connecting said oil-cooling heat exchanger to return refrigerant to said condenser includes the step of delivering refrigerant from said oil-cooling heat exchanger into the vapor space of said condenser.

19. The method according to claim 18 including the step of inducing and maintaining the flow of refrigerant in said flowing steps in the absence of any valves or controls or motive force, other than said density difference and said static head, for establishing or regulating such flow.

20. The method according to claim 19 wherein said passing step includes the step of delivering said relatively warm lubricant into said oil-cooling heat exchanger generally at a location where said liquid refrigerant is received into said oil-cooling heat exchanger so that the initial heat exchange that occurs between said oil and said liquid refrigerant in said heat exchanger is at a location where the difference in temperature between said oil and said refrigerant is generally at its highest within said heat exchanger.

* * * * *